US008608518B2

(12) United States Patent
Wu

(10) Patent No.: US 8,608,518 B2
(45) Date of Patent: Dec. 17, 2013

(54) WIRE-GRASPING STRUCTURE FOR TERMINAL BLOCK

(75) Inventor: Shang Tsai Wu, New Taipei (TW)

(73) Assignee: Dinkle Enterprise Co., Ltd., New Taipei (TW)

( * ) Notice: Subject to any disclaimer, the term of this patent is extended or adjusted under 35 U.S.C. 154(b) by 42 days.

(21) Appl. No.: 13/473,404

(22) Filed: May 16, 2012

(65) Prior Publication Data

US 2013/0309917 A1 Nov. 21, 2013

(51) Int. Cl.
*H01R 4/36* (2006.01)

(52) U.S. Cl.
USPC ..... 439/812

(58) Field of Classification Search
USPC ..... 439/812, 709, 813, 793, 810, 811, 718, 439/815; 174/84
See application file for complete search history.

(56) References Cited

U.S. PATENT DOCUMENTS 4,273,408 A * 6/1981 Orr ..... 439/737
5,249,989 A * 10/1993 Alsch ..... 439/812
5,580,286 A * 12/1996 Kramer et al. ..... 439/813
5,704,815 A * 1/1998 Shibata et al. ..... 439/709
5,747,741 A * 5/1998 Alsch ..... 174/84 C
5,842,890 A * 12/1998 Gimenez ..... 439/718
6,361,382 B1 * 3/2002 Yamada et al. ..... 439/813
6,475,038 B1 * 11/2002 Franck ..... 439/811
7,041,921 B2 * 5/2006 Kadan et al. ..... 200/293
7,909,633 B1 * 3/2011 Miller et al. ..... 439/441
8,241,074 B2 * 8/2012 Watford et al. ..... 439/814

* cited by examiner

*Primary Examiner* — Alexander Gilman
(74) *Attorney, Agent, or Firm* — Birch, Stewart, Kolasch & Birch, LLP

(57) ABSTRACT

A wire-grasping structure for a terminal block includes a seat part, a fixing piece, a cover part, a fastening piece, a screw and a spring. The seat part has a transverse opening. The fixing piece is received in a lower accommodating recess of the seat part to slide in the seat part vertically. The cover part covers the seat part. The fastening piece is sandwiched between the cover part and the seat part. The screw is vertically received in an upper accommodating recess of the cover part and aligned with the through hole of the fastening piece and the threaded hole of the fixing piece. The spring is vertically received in the upper accommodating recess of the cover part and has two ends abutting against the fastening piece and the screw. The wire-grasping structure has good wire-grasping reliability and good applicability and is convenient to use.

4 Claims, 6 Drawing Sheets

WIRE-GRASPING STRUCTURE FOR TERMINAL BLOCK

BACKGROUND OF THE INVENTION

1. Technical Field

The present invention relates to terminal blocks of electronic devices, and more particularly, to a wire-grasping structure for a terminal block, wherein the wire-grasping structure has good wire-grasping reliability and good applicability and is convenient to use.

2. Description of Related Art

Terminal blocks are widely used in electronic devices for wire connection. A typical terminal block is a combination of several wire-grasping structures each grasping a circuit wire for electrical connection with other electronic components so that signal communication among electronic components can be established in the electronic device.

However, the existing wire-grasping structures typically use simple screws or clamping pieces to hold electric wires and tend to have the clamped wires loosen and leaving, so the wire-grasping reliability thereof needs to be improved.

In addition, an electronic device may use more than one type of electric wires for meeting its application needs. These electric wires may include general wires (i.e. peeled wires), wires with O-shaped terminals, wires with Y-shaped terminal and so on. The foregoing conventional wire-grasping structures simply using screws or clamping pieces are unable to fix electric wires of all these and other types reliably. Even if a user manage to do so, the operation would be very inconvenient. For example, in order to install a wire with an O-shaped terminal onto a terminal block using screws as a wire-grasping member, the screw has to be first removed from the terminal block. Thus, the conventional wire-grasping structures are inflexible in application and inconvenient to use, so am improvement thereto is desired.

SUMMARY OF THE INVENTION

According to the present invention, a wire-grasping structure for a terminal block comprises a seat part, at least one fixing piece, a cover part, at least one fastening piece, at least one screw and at least one spring.

Therein, the seat part has at least one lower accommodating recess, at least one transverse opening and at least one vertical opening. The at least one transverse opening communicates the at least one lower accommodating recess with the exterior of the seat part and the at least one vertical opening is communicated with the at least one lower accommodating recess. The at least one fixing piece is slidably received in the at least one lower accommodating recess so that it can slide vertically with respect to the seat part. The at least one fixing piece is vertically formed with a threaded hole.

In addition, the cover part covers the seat part and includes at least one upper accommodating recess, at least one upper vertical opening, at least one lower vertical opening and at least one shoulder. The at least one upper vertical opening communicates the at least one upper accommodating recess with the exterior of the cover part. The at least one lower vertical opening communicates the at least one upper accommodating recess with the at least one vertical opening. The at least one shoulder is adjacent to the at least one upper vertical opening. The at least one fastening piece is sandwiched between the cover part and the seat part and adjacent to the at least one upper accommodating recess and the at least one lower accommodating recess. The at least one fastening piece is formed with at least one through hole that is aligned with the threaded hole of the at least one fixing piece.

Furthermore, the at least one screw is vertically received in the at least one upper accommodating recess and has a head and a threaded portion that connect each other. The head abuts against the at least one shoulder, and the threaded portion is aligned with the at least one through hole and the threaded hole. The at least one spring is vertically received in the at least one upper accommodating recess and has two ends thereof abutting against the at least one fastening piece and the at least one screw, respectively.

With the foregoing configuration, the wire-grasping structure has good wire-grasping reliability and good applicability and is convenient to use.

The at least one fixing piece may have a reverse-U shape or may be made into a different shape.

The head of the at least one screw has a lower surface formed with an annular recess so that the upper end of the at least one spring is received in the annular recess.

The at least one spring is a conical spring.

BRIEF DESCRIPTION OF THE DRAWINGS

The invention as well as a preferred mode of use, further objectives and advantages thereof will be best understood by reference to the following detailed description of an illustrative embodiment when read in conjunction with the accompanying drawings, wherein.

DETAILED DESCRIPTION OF THE INVENTION

Figure 1:
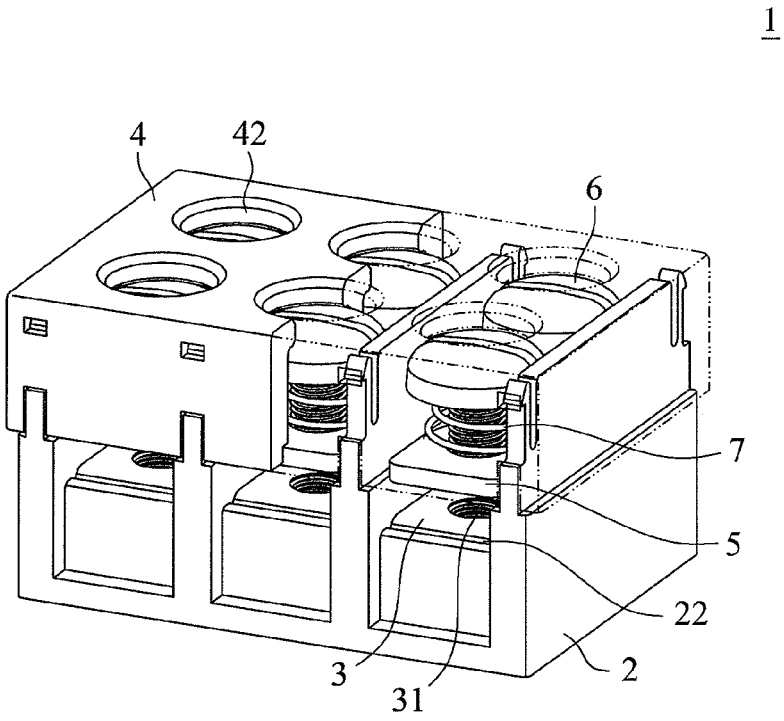
FIG. 1 is a cut-away perspective view of one preferred embodiment of the present invention.
Figure 2:
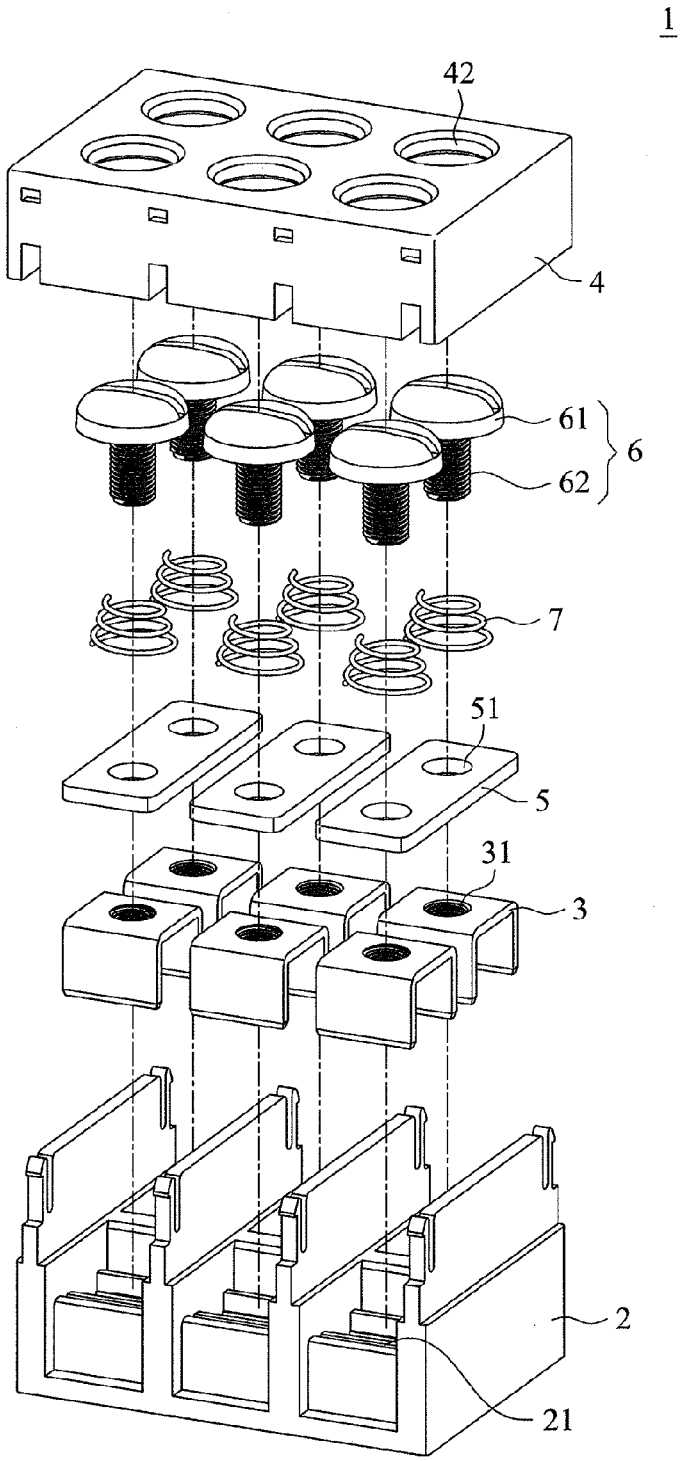
FIG. 2 is an exploded view of the preferred embodiment of the present invention.
Figure 3:
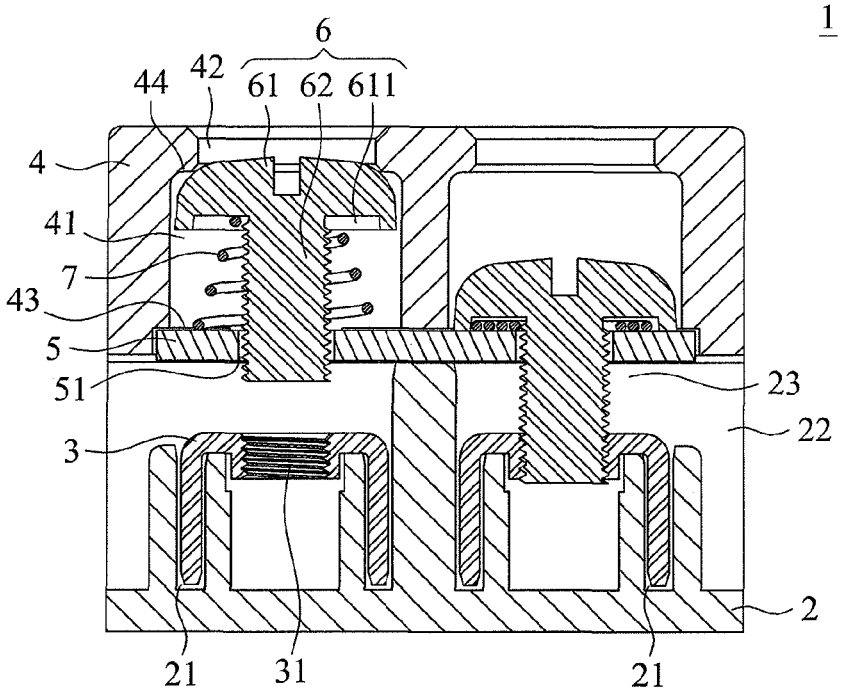
FIG. 3 is a cross-sectional view of the preferred embodiment of the present invention.

Please refer to FIG. 1 through FIG. 3. FIG. 1 is a cut-away perspective view of a preferred embodiment of the present invention, wherein its cover part is partially removed for showing its interior clearly. FIG. 2 is an exploded view of the embodiment of the present invention. FIG. 3 is a cross-sectional view of the embodiment of the present invention.

As shown in the drawings, a wire-grasping structure 1 for a terminal block has a seat part 2, at least one fixing piece 3, a cover part 4, at least one fastening piece 5, at least one screw 6 and at least one spring 7.

The seat part 2 as depicted includes at least one lower accommodating recess 21, at least one transverse opening 22 and at least one vertical opening 23. The at least one transverse opening 22 communicates the at least one lower accommodating recess 21 with the exterior of the seat part 2. The at least one vertical opening 23 is communicated with the at least one lower accommodating recess 21. At least one fixing piece 3 is slidably received in the at least one lower accommodating recess 21 and can slide vertically along the seat part 2. The at least one fixing piece 3 is vertically formed with a threaded hole 31.

As shown, the cover part 4 covering the seat part 2 from top has at least one upper accommodating recess 41, at least one upper vertical opening 42, at least one lower vertical opening 43 and at least one shoulder 44. The at least one upper vertical opening 42 communicates the at least one upper accommodating recess 41 with the exterior of the cover part 4. The at least one lower vertical opening 43 communicates the at least one upper accommodating recess 41 and the at least one vertical opening 23 of the seat part 2. The at least one shoulder 44 is adjacent to the at least one upper vertical opening 42. The at least one fastening piece 5 is sandwiched between the cover part 4 and the seat part 2 and is adjacent to the at least one upper accommodating recess 41 and the at least one lower accommodating recess 21. In addition, the at least one fastening piece 5 is formed with at least one through hole 51, which is aligned with the threaded hole 31 of the at least one fixing piece 3.

Moreover, as shown, the at least one screw 6 is vertically received in the at least one upper accommodating recess 41 of the cover part 4. The at least one screw 6 includes a head 61 and a threaded portion 62 that connect each other. The head 61 is to abut against the shoulder 44 of the cover part 4, and the threaded portion 62 is to be aligned with the at least one through hole 51 of the at least one fastening piece 5 and the threaded hole 31 of the at least one fixing piece 3. The at least one spring 7 is vertically received in the at least one upper accommodating recess 41 of the cover part 4 and has two ends thereof abutting against the at least one fastening piece 5 and the head 61 of the at least one screw 6, respectively.

As shown in FIG. 1 through FIG. 3, in the present embodiment, the numbers of the lower accommodating recess 21, the transverse opening 22 and the vertical opening 23 of the seat part 2 are all six. The number of the fixing piece 3 is six. The numbers of the upper accommodating recess 41, the upper vertical opening 42, the lower vertical opening 43 and the shoulder 44 of the cover part 4 are all six. The number of the at least one fastening piece 5 is three and each said fastening piece 5 is formed with two through holes 51, meaning that there are six through holes 51 in total. The number of the at least one screw 6 is six and the number of the at least one spring 7 is also six. In other words, in the present embodiment, as depicted in the drawings, there are six wire-grasping structures provided as an assembly. However, the numbers of all the components may be changed according to practical needs.

With the above configuration, the disclosed wire-grasping structure has good wire-grasping reliability and good applicability and is convenient to use.

For further illustration, referring to the FIG. 3, the left wire-grasping structure is now idle and the right one has its screw 6 screwed downward to fix a wire.

As shown in FIG. 3, in the left, idle wire-grasping structure, the screw 6 is pushed upward by the spring 7 and the head 61 of the screw 6 abuts against the shoulder 44 of the cover part 4 so that the screw 6 is secured from being shot out by the spring 7. The threaded portion 62 of the screw 6 is now aligned with the through hole 51 of the fastening piece 5 and the threaded hole 31 of the fixing piece 3.

When a user uses, for example, a slotted screwdriver (not shown) to drive the screw 6 through the upper vertical opening 42 of the cover part 4, the screw 6 moves from the upper accommodating recess 41 of the cover part 4 toward the lower accommodating recess 21 of the seat part 2, with the threaded portion 62 thereof engaged with the threaded hole 31 of the fixing piece 3. In response to the user's further screwing the screw 6, the fixing piece 3 moves upward vertically with respect to the seat part 2 due to the thread engagement of the threads, and approaches to the fastening piece 5.

Therefore, when an electric wire (as described in detail below) is inserted to the lower accommodating recess 21 of the seat part 2 of the idle wire-grasping structure (i.e. the left one in FIG. 3) through the transverse opening 22, by screwing the screw 6, the wire can be firmly held between the fixing piece 3 and the fastening piece 5.

Figure 4:
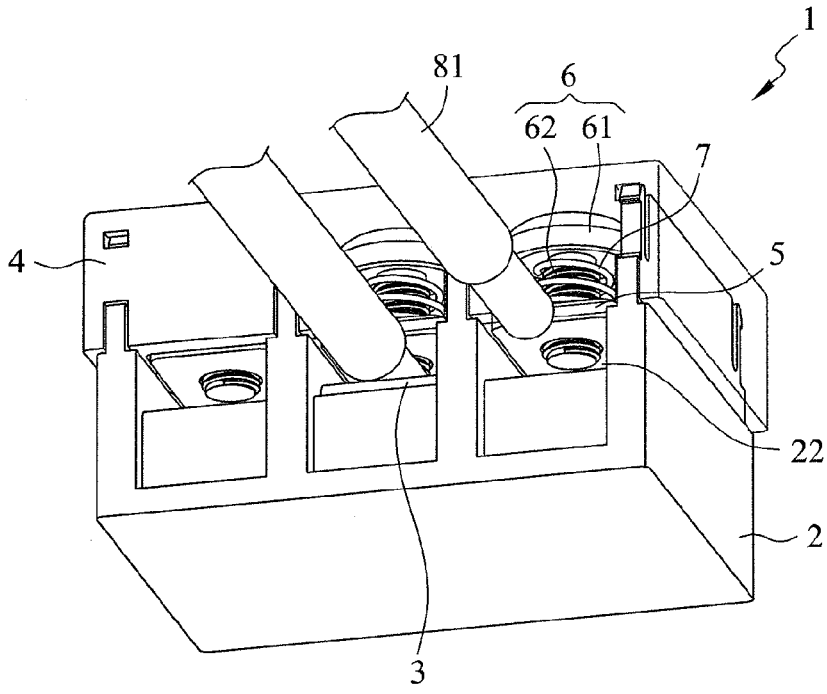
FIG. 4 is one applied view of the preferred embodiment of the present invention.

Please refer to FIG. 4, which is one applied view of the preferred embodiment of the present invention, together with FIG. 1 through FIG. 3.

As can be seen in FIG. 4, a general wire 81 (i.e. a wire 81 with its coating layer partially peeled for facilitating wire fixing) is depicted. As described previously, after the wire 81 is inserted into the lower accommodating recess 21 through the transverse opening 22 of the seat part 2, the screw 6 is driven to fix the wire 81 firmly between the fixing piece 3 and the fastening piece 5.

Figure 5:
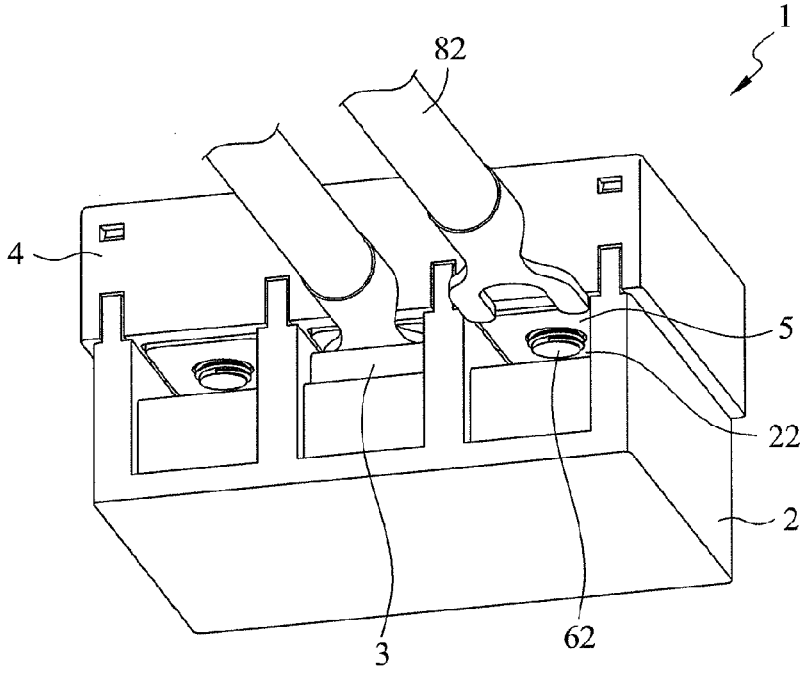
FIG. 5 is another applied view of the preferred embodiment of the present invention.

Please refer to FIG. 5, which is another applied view of the preferred embodiment of the present invention, together with FIG. 1 through FIG. 3.

As can be seen in FIG. 5, a wire with a Y-shaped terminal 82 is similarly inserted into the lower accommodating recess 21 through the transverse opening 22 of the seat part 2 with its Y-shaped terminal embracing the threaded portion 62 of the screw 6. Afterward, the screw 6 is driven to fix the wire 82 firmly between the fixing piece 3 and the fastening piece 5.

Figure 6:
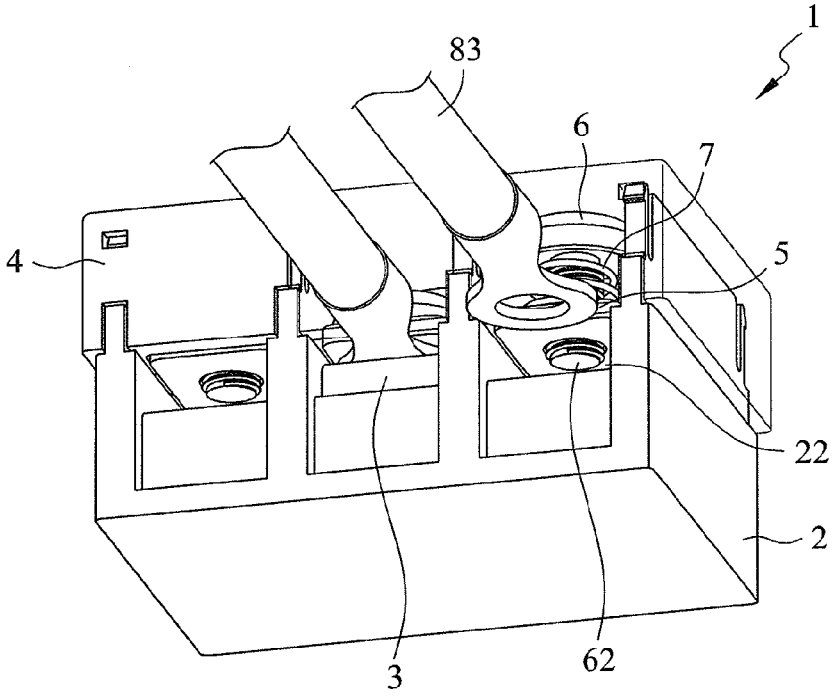
FIG. 6 is still another applied view of the preferred embodiment of the present invention.

Please refer to FIG. 6, which is still another applied view of the preferred embodiment of the present invention, together with FIG. 1 through FIG. 3.

As can be seen in FIG. 6, a wire with an O-shaped terminal 83 is similarly inserted into the lower accommodating recess 21 through the transverse opening 22 of the seat part 2 with its O-shaped terminal mounted around the threaded portion 62 of the screw 6. Since the shoulder 44 of the cover part 4 abuts against the head 61 of the screw 6 and thereby retains the screw 6 from being shot out by the spring 7, the screw 6 is suspended in the upper accommodating recess 41. Thereby, the O-shaped terminal of the wire 83 can be easily inserted to the lower accommodating recess 21 and mounted around the threaded portion 62 of the screw 6 from the bottom of the threaded portion 62 and there is no need to remove the screw 6 from the wire-grasping structure. Afterward, the screw 6 is driven to fix the wire 83 firmly between the fixing piece 3 and the fastening piece 5.

To sum up, using the inventive wire-grasping structure, the electric wires 81, 82 and 83 can be firmly grasped and positioned between the fixing piece 3 and the fastening piece 5. As the fixed wires 81, 82 and 83 are unlikely to leave, the wire-grasping reliability of the wire-grasping structure is ensured.

Additionally, the inventive wire-grasping structure is adaptive to a general wire 81, a wire with a Y-shaped terminal 82 and a wire with an O-shaped terminal 83, so it is more applicable and convenient as compared to the prior-art design.

In the present embodiment, the fixing piece 3 is in a reverse-U shape, and the lower accommodating recess 21 of the seat part 2 is formed with a sliding groove fitting the fixing piece 3. Of course, the fixing piece 3 may be formed in a different shape.

Furthermore, in the present embodiment, the head 61 of the screw 6 has its lower surface formed with an annular recess 611, and the spring 7 has its upper end received in the annular recess 611, so that the spring 7 is secured by the annular recess 611 and unlikely to move with respect to the head 61.

In the present embodiment, the spring 7 is a conical spring that has a tapered sectional shape. As shown in FIG. 3, when the screw 6 is driven to compress the spring 7, the spring 7 in the form of a conical spring can be compressed into a flat structure and completely received in the annular recess 611 of the head 61 of the screw 6, thereby significantly saving space required and in turn saving material costs.

What is claimed is:

1. A wire-grasping structure for a terminal block, the wire-grasping structure comprising:

a seat part including at least one lower accommodating recess, at least one transverse opening and at least one vertical opening, wherein the at least one transverse opening communicates the at least one lower accommodating recess with an exterior of the seat part, and the at least one vertical opening is communicated with the at least one lower accommodating recess;

at least one fixing piece being slidably receiving in the at least one lower accommodating recess so as to be allowed to vertically slide with respect to the seat part, and the at least one fixing piece being vertically formed with a threaded hole;

a cover part covering on the seat part and including at least one upper accommodating recess, at least one upper vertical opening, at least one lower vertical opening and at least one shoulder, wherein the at least one upper vertical opening communicates the at least one upper accommodating recess with an exterior of the cover part, and the at least one lower vertical opening communicates the at least one upper accommodating recess with the at least one vertical opening, while the at least one shoulder is adjacent to the at least one upper vertical opening;

at least one fastening piece being sandwiched between the cover part and the seat part and adjacent to the at least one upper accommodating recess and the at least one lower accommodating recess, wherein the at least one fastening piece is formed with at least one through hole that is aligned with the threaded hole of the at least one fixing piece;

at least one screw being vertically received in the at least one upper accommodating recess and having a head and a threaded portion that connect each other, wherein the head abuts against the at least one shoulder and the threaded portion is aligned with the at least one through hole and the threaded hole; and at least one spring being vertically received in the at least one upper accommodating recess and having two ends thereof abutting against the at least one fastening piece and the head of the at least one screw, respectively.

2. The wire-grasping structure of claim 1, wherein the at least one fixing piece has a reverse-U shape.

3. The wire-grasping structure of claim 1, wherein the head of the at least one screw has a lower surface formed with an annular recess so that the upper end of the at least one spring is received in the annular recess.

4. The wire-grasping structure of claim 1, wherein the at least one spring is a conical spring.

* * * * *